US005432968A

United States Patent [19]

Beck

[11] Patent Number: 5,432,968

[45] Date of Patent: Jul. 18, 1995

[54] UTILITY HAND TOOL

[76] Inventor: Martin E. Beck, 664 35th St., Manhattan Beach, Calif. 90266

[21] Appl. No.: 181,783

[22] Filed: Jan. 18, 1994

[51] Int. Cl.[6] ..... B25B 7/22

[52] U.S. Cl. ..... 7/128; 7/127; 7/138

[58] Field of Search ..... 7/126, 127, 128, 138

[56] References Cited

U.S. PATENT DOCUMENTS

| | | | |
|---|---|---|---|
| 1,321,777 | 11/1919 | Stepanian | 7/127 X |
| 4,512,051 | 4/1985 | Magan | 7/128 |
| 4,995,128 | 2/1991 | Montgomery et al. | 7/127 |
| 5,033,140 | 7/1991 | Chen et al. | 7/127 |
| 5,119,520 | 6/1992 | Finn | 7/127 |

*Primary Examiner*—James G. Smith

[57] ABSTRACT

A universal tool is disclosed having a pair of jaw members adapted to be oriented between two operative positions to perform a variety of hand tool procedures. In one position, the jaw members cooperate as channel locks or pliers while in the other position, one jaw member acts as a handle extension for crescent wrench, screwdriver or hammer purposes. A flat file, a folding knife blade and screwdriver with receptacle bit holder are carried on one jaw member. A latch mechanism releasably retains the jaw members in either of their operative positions.

9 Claims, 2 Drawing Sheets

UTILITY HAND TOOL

BACKGROUND OF THE INVENTION

1. Field of the Invention

The present invention relates to the field of hand tools, and more particularly to a versatile hand tool having a pair of members adapted to be placed in either of two positions so that a variety of hand tool procedures can be carried forth.

2. Brief Description of the Prior Art

In the past, it has been the conventional practice to provide hand tools which, when used separately, perform a variety of hand tool procedures. Obviously, a separate tool is needed for each procedure and, therefore, a multiplicity of tools is usually carried in a tool box, waist belt or the like so that the tools will be available for use by a workman. In some instances, attempts have been made to combine several tools into a single unit or unitary construction whereby a variety of procedures can be performed with a single implement or tool.

Difficulties and problems have been encountered when dealing with such combination tools, which stem largely from the fact that the tool is unduly complicated or complex to use so that its function has many shortcomings. In other instances, only one or two procedures can be performed with the combination tool so that its usefulness is greatly limited. In other instances, such as multiple knives or eating utensils, combinations of implements have been made which are generally not detachable from one another and which are held together by a variety of pivots, fixed studs or rivets. All of the above attempts are extremely costly to manufacture and uneconomical to produce with accuracy.

Therefore, a long-standing need has existed to provide a hand tool which incorporates a plurality of movable parts adapted to provide a multiplicity of hand tool purposes. Such a device must be simple to operate and may incorporate parts that are removable with respect to one another so that they may be reoriented to provide required procedures.

SUMMARY OF THE INVENTION

Accordingly, the above problems and difficulties are avoided by the present invention which provides a novel utility hand tool having a first and a second jaw member detachably joined together by a stud headed pivot. A releasable latch mechanism holds the jaw members in a shortened operative position or an extended operative position depending upon intended use of the tool. The first jaw member is elongated, having a screwdriver at one end and jaw portion of a channel lock or pliers at its opposite end, and which further includes a pivotal knife blade, a flat file and a bit storage receptacle, these latter elements being carried between the opposite ends of the first jaw member. The second jaw member is elongated, having a crescent wrench on one end with a hammer head integrally formed therewith and further includes a jaw portion of the channel lock or pliers on its other end. The jaw portions cooperate with each other when the jaw members are in their shortened operative position to function as a complete channel lock or pliers. The second jaw member further includes an elongated slot through which the stud pivot is placed whereby orientation of one jaw member with respect to the other jaw member permits the stud pivot to slip through the elongated slot so that the jaw members may be separated and reoriented with respect to each other to provide either the shortened position or the extended operative position.

Therefore, it is among the primary objects of the present invention to provide a novel utility hand tool having a pair of members that may be separated and oriented with respect to one another so that upon joining, a variety of hand tool procedures can be carried out.

Another object of the present invention is to provide a multi-purpose hand tool incorporating a variety of hand tool elements, such as a crescent wrench, a pliers, a channel lock tool, a screwdriver, a file or the like, and whereby the tool elements are carried on a pair of members that are correlated with one another so that the desired implements and tool elements can be in a selected position for performing a variety of hand tool procedures.

Yet another object of the present invention is to provide a novel hand tool having a pair of members carrying a variety of tool elements whereby the members can be oriented with respect to one another to provide extensions for the respective tool elements and which may be separated from one another .so that a variety of tool procedures can be performed.

Yet another object of the present invention is to provide a combination hand tool having a variety of tool elements carried on separable elongated members so that the members are adapted to be selectively oriented with respect to each other so that the tool procedures can be attained.

Still another object of the present invention is to provide a novel hand tool capable of performing a variety of tool procedures, which is relatively inexpensive to manufacture when compared with the manufacture, distribution and usage of a multiplicity of separate tool elements which are generally needed by a workman.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
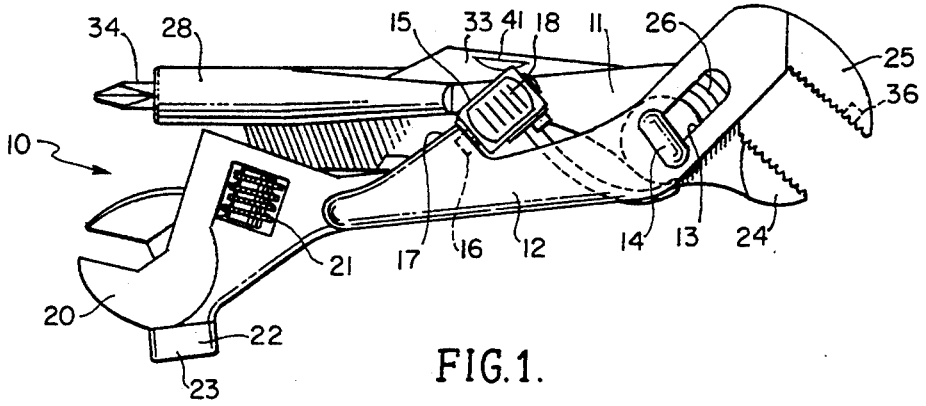
FIG. 1 is a side elevational view of the combination utility hand tool of the present invention illustrated in its shortened operative position.
Figure 2:
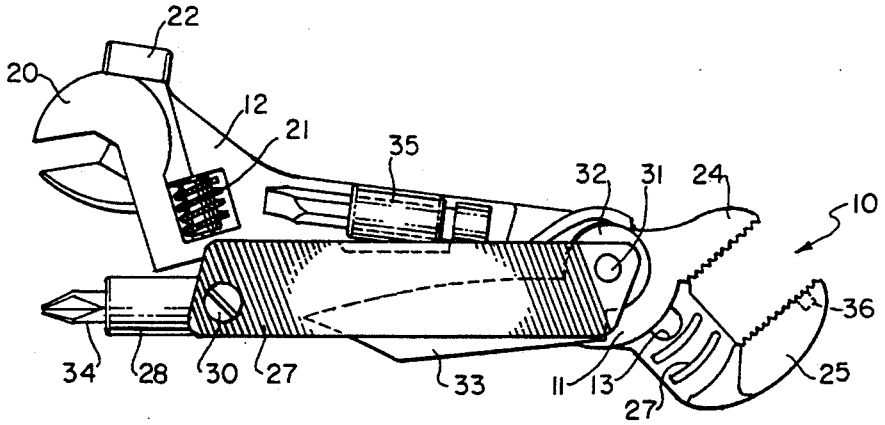
FIG. 2 is a view similar to the view of FIG. 1 illustrating the opposite side of the inventive utility hand tool.

Referring to FIG. 1, the novel hand tool of the present invention is indicated in the general direction of arrow 10 which includes a first jaw member 11 and a second jaw member, indicated by numeral 12. Jaw member 12 includes an elongated slot 13 accommodating a stud headed pivot 14 so that the jaw members 11 and 12 may be pivotally related to one another. In order to connect or disconnect the jaw members from one another, the members are pivoted so that the elongation of the head on the stud 14 is in alignment with the slot whereby member 12 may be separated from the jaw member 11. The width of the stud on pivot 14 is more narrow than the width of elongated slot 13. However, as illustrated in FIGS. 1 and 2, the jaw members are assembled together and are held in a first stored operative position by means of a spring latch 15 having a plunger which extends into a hole 16 in step 17 integrally formed at the midsection of the jaw member 12. A thumb or finger release 18 may be operated to urge the plunger out of hole 16 against the expansion spring within the latch when it is desired to move or separate the jaw members with respect to each other.

Figure 3:
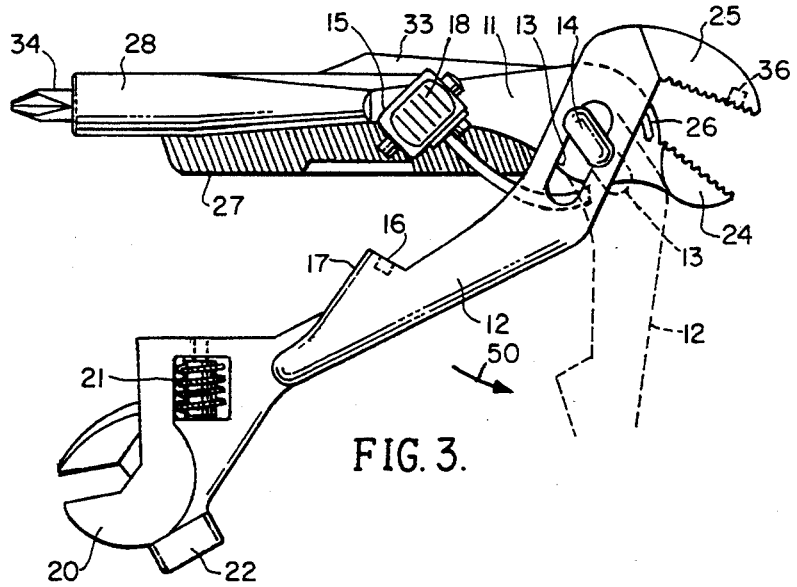
FIG. 3 is a side elevational view similar to the view of FIG. 1 illustrating one jaw member pivoted with respect to the other jaw member preparatory for separation.

FIGS. 2 and 3 also illustrate that one end of the elongated jaw member 12 includes a crescent wrench, indicated by numeral 20, and that the jaws of the wrench may be opened or closed by rotation of the finger operated spindle 21. The jaw member 12 further includes an enlarged or thickened mass. of material representing a hammer, as indicated by numeral 22. The mass of the hammer includes a flat surface which may be employed for impacting against nails or the like wherein the combined jaw members 11 and 12 may be used as a handle for either the hammer or the wrench during a work procedure. The opposite end of jaw member 12 includes a jaw portion 24 which cooperates with a jaw portion 25 carried on one end of the elongated jaw member 11. Therefore, the jaw member portions 24 and 25 constitute a pliers or a channel lock at the will of the user. With respect to the channel lock usage, jaw member portion 25 includes ridges 26 which cooperate with ridges 27 carried on jaw portion 24, as illustrated in FIG. 2. Therefore, by moving the jaw portions with respect to one another so as to align the ridge 26 with the ridges 27, the distance between the opposing tooth surfaces of the jaw portions can be adjusted.

FIG. 2 further illustrates that the jaw member 11 may include a flat file 27 attached to the midsection of jaw member 11 while a screwdriving portion 28 is carried on the end of jaw member 11 opposite to its end carrying jaw portion 25. Such attachment means may include a screw 30 and a rivet 31 which is also used as the pivot for the stud headed pivot 14. A spacer is identified by numeral 32, which resides between one end of the flat file 27 and the opposing surface of the jaw member 11. The space defined therebetween is partially occupied by a knife blade 33 which will be described later. With respect to the screwdriving portion 28, the portion includes a receptacle for insertably receiving a selected one of several screwdriving bits, such as indicated by numeral 34. A storage receptacle 35 is carried on jaw member 12 so that a spare or extra drill or screwdriving bit may be incorporated therein.

Referring now in detail to FIG. 3, the assembly of jaw members 11 and 12 is the same as shown in FIGS. 1 and 2; however, the orientation is different since the latch 15 has been removed from the hole 16 by the bias from slide 18 so that member 12 may pivot about the stud headed pivot 14. The elongation of the pivot head is such that the opposite ends extend beyond the width of the slot 13 so that the member 11 and 12 are held together in sliding relationship whereby the member 12 may be extended to increase the distance between the toothed jaw surfaces of portions 24 and 25 or, if desired, the distance may be decreased for whatever work procedure is required. In this orientation, the jaw portions 24 and 25 are used for channel lock purposes or for usage as pliers. In some instances, it may be advantageous to use the screwdriving bit 34 employing the member 12 as a partial handle for twisting or obtaining leverage during a screwdriving procedure.

Figure 4:
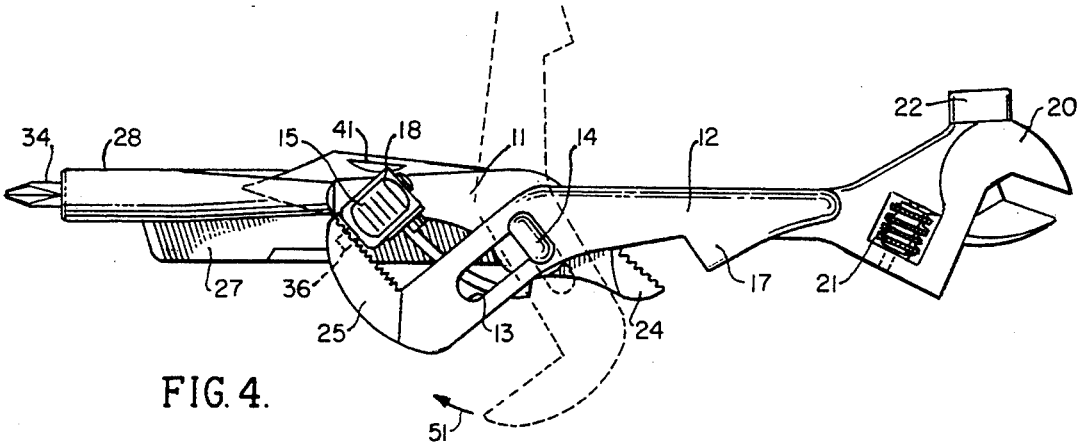
FIG. 4 is a side elevational view of the novel utility hand tool illustrating a second operative position with respect to the pair of jaw members.
Figure 5:
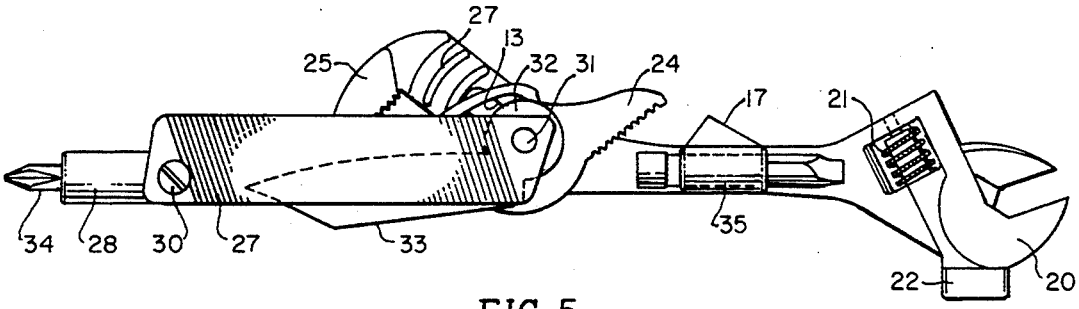
FIG. 5 is a view similar to the view of FIG. 4 illustrating the opposite side of the utility hand tool.
Figure 7:
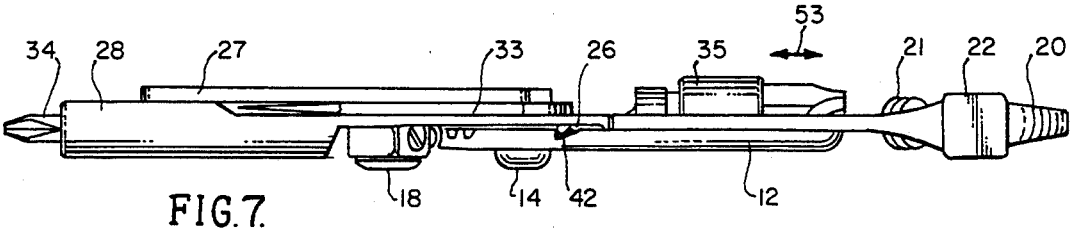
FIG. 7 is a top plan view of the utility hand tool shown in FIG 4.

Referring now in detail to FIGS. 4, 5 and 7, the jaw members 11 and 12 are locked in a second extended operative position whereby the jaw members 11 and 12 are coextensive with one another having the screwdriving bit 34 available for a screwdriving procedure with the jaw member 12 in a fixed extended position serving as a handle. Alternately, when in this position, the jaw member 11 may become the handle while either the hammer or the crescent wrench carried at the end of member 12 can be used for a working procedure. In order to releasably secure jaw members 11 and 12 together, it can be seen that the toothed jaw surface of portion 25 is provided with a hole 36 into which the plunger 15 may be inserted. When the latch mechanism extends the plunger into the hole 36, the members are fixed together. The latch cooperates with the headed stud pivot 14 which is disposed at the extreme end of slot 13. Therefore, the jaw members cannot pivot with respect to one another and are in a fixed end-to-end extended relationship.

In order to place the member in the extended operative position, as shown in FIGS. 4 and 5, the jaw member must be separated from one another and the member 12 must be turned and rejoined with member 11 by inserting the stud headed pivot through the slot 13 as oriented in FIG. 4 from the orientation shown in FIG. 3. In this manner, the hole 36 will be aligned with the plunger 15 for releasable engagement.

Figure 6:
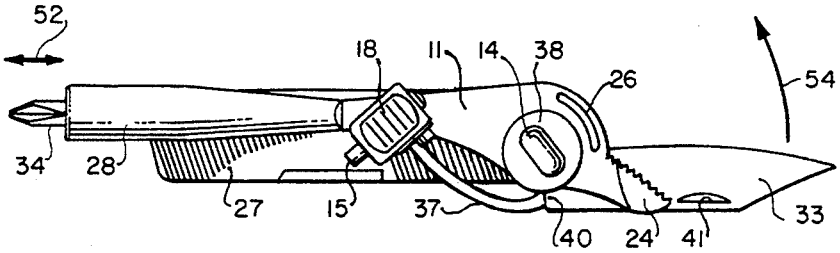
FIG. 6 is a side elevational view of one jaw member illustrating a knife blade in its unfolded or extended position.

Referring now in detail to FIG. 6, the knife blade 33 is illustrated in its operative or extended position wherein the blade is held in this position by means of a spring 37 which normally rides about the peripheral surface of a disc 38 carried immediately beneath and in spaced relationship to the stud headed pivot 14. The extreme end of spring 37 bears against a shoulder 40 of the blade 33 in order to support and stabilize the blade in its operative position. The blade is rotated from its stored position, as shown in FIGURES preceding to its operative position by manually grasping a thumb depression 41 and urging the blade to rotate about the pivot until the shoulder 14 bears against the end of spring 37.

To further stabilize the joining of the opposite ends of the jaw members 11 and 12 together, it can be seen in FIG. 7 that a semicircular slot 42 is included and that the single ridge 26 carried on the inside surface of jaw portion 25 rides in this notch as the members are turned to end up in the position shown in FIGS. 4 and 5.

In view of the foregoing, it can be seen that the utility hand tool of the present invention provides a unitary and convenient means for performing a variety of hand tool procedures by manipulating the jaw members 11 and 12 respectively. For example, as shown in FIGS. 1 and 2, the jaw members 11 and 12 are fixed together in a storage or non-extended position. As such, the tool may be used as a crescent wrench, a fixed wrench, a flat file and as a hammer. As illustrated in FIG. 3, the jaw members 11 and 12 are oriented such that the stud headed pivot 14 has been arranged with the slot 13 by moving member 12 in the direction of arrow 50 to the dotted line showing. When the slot 13 is in alignment with the elongated stud headed pivot 14, the jaw member 25 is lifted or separated from jaw member 11. When so separated, the member 11 may be used as shown in FIG. 6 or when recombined with the jaw member 12, the assembly may be shown and used as previously described with respect to FIGS. 4, 5 and 7. With respect to the latter assemblage, the extension is provided by taking the separated jaw member 12 and realigning the slot 13 with stud headed pivot 14 whereby the member 12 is rotated in the direction of arrow 51. When rotation clockwise has progressed to where the hole 36 is under the latch plunger 15, rotation will stop and releasable securement will take place between the two jaw members. For this rotation, the ridge 26 will follow through the slot 42, as shown in FIG. 7.

In FIG. 6, the device may be used as a screwdriver and the bit 34 may be removed and a more suitable bit inserted at the desire of the worker. The storage bit carried in receptacle 35 may be an alternate. Arrow 52 indicates the withdrawal or insertion of the drill bit 34 into or out of the receptacle 28 whereas the arrow 53 in FIG. 7 illustrates the insertion or removal of the alternate bit from the storage holder or receptacle 35. The knife blade 33 may be opened to the position shown in FIG. 6 and may be closed when pivoted in the direction of arrow 54 to a stored or closed position.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A hand tool comprising:

a pair of elongated jaw members having a first and a second jaw member adapted to be oriented between a first position and a second position operative to perform a variety of hand tool procedures;

a stud pivot detachably connecting said jaw members together in either of their operative positions;

latch means carried on said jaw members releasably retaining said jaw members in either of their operative positions;

each of said jaw members having multiple hand tool implements manually operated when said jaw members are retained in either of their operative positions; and said releasable latch means includes a spring-biased rod carried on said first jaw member midway between its opposite ends and a shoulder receptacle carried on said second jaw member insertably receiving said rod to retain said jaw members in said first position and a jaw receptacle provided in said jaw portion of said second jaw member to retain said jaw members in said second position.

2. The invention as defined in claim 1 wherein:

said jaw members in said first position having said jaw members in side-by-side relationship;

a crescent wrench carried on an end of a second jaw member of said pair of jaw members with a screwdriver carried on an end of said second jaw member of said pair of jaw members in fixed relationship to and adjacent to said crescent wrench; and adjacent ends of said jaw members opposite to their ends carrying said crescent wrench and screwdriver respectively carrying a jaw portion cooperating to serve in opposition to constitute a pliers or a channel lock.

3. The invention as defined in claim 2 wherein:

said jaw members in said second position having said jaw members in an end-to-end relationship whereby said screwdriver and said crescent wrench are at opposite ends of said jaw members in said end-to-end relationship.

4. The invention as defined in claim 3 wherein:

said stud pivot is fixedly carried on said first jaw member adjacent to said jaw portion thereof; and said second jaw member having an elongated slot partially occupied by said stud pivot so as to place said jaw members in rotational relationship.

5. The invention as defined in claim 4 including:

an arcuate slot provided on said second jaw member adjacent to its associated jaw portion; and an arcuate rib carried on said first jaw member adapted to slide within said slot when said jaw members rotate about said stud pivot to achieve said second position.

6. The invention as defined in claim 5 including:

a hammer integrally disposed on said crescent wrench having an exposed impact surface.

7. The invention as defined in claim 5 including:

a knife blade having one end thereof pivotally secured to said first jaw member about said stud pivot; and spring biasing means carried on said first jaw member yieldably urging said knife blade into a closed position.

8. The invention as defined in claim 2 wherein:

said first jaw member includes an open-ended holder and a screwdriving bit slidably insertable into said holder with a portion of said screwdriver exposed exteriorly of said holder.

9. The invention as defined in claim 4 wherein:

said jaw members being separable for manual orientation to achieve either of said first or second positions via said elongated slot and said stud pivot; and said releasable latch means comprising:

a pair of receptacles carried on said second jaw member in fixed spaced-apart relationship; and a latch movably carried on said first jaw member operable to engage a selected one of said pair of receptacles to retain said jaw members in either of their operative positions.

* * * * *